US005490360A

United States Patent [19]

Fifield et al.

[11] Patent Number: 5,490,360

[45] Date of Patent: Feb. 13, 1996

[54] ROOFING ELEMENTS

[75] Inventors: John A. Fifield, Aylesbury, Great Britain; Paul V. Childress, Warrenton, Va.

[73] Assignee: Oldcastle Inc., Los Angeles, Calif.

[21] Appl. No.: 352,980

[22] Filed: Dec. 9, 1994

Related U.S. Application Data

[63] Continuation of Ser. No. 70,150, May 28, 1993, abandoned.

[30] Foreign Application Priority Data

May 29, 1992 [GB] United Kingdom ..... 9211351

[51] Int. Cl.[6] ..... E04D 1/00

[52] U.S. Cl. ..... 52/533; 52/302.3; 52/604

[58] Field of Search ..... 52/533, 534, 536, 52/302.1, 302.3, 302.4, 589–595, 284, 286, 603, 604; 404/41

[56] References Cited

U.S. PATENT DOCUMENTS

| | | | |
|---|---|---|---|
| 633,019 | 12/1899 | Ludeling | 52/533 |
| 1,974,130 | 9/1934 | Wedberg | 404/41 |
| 2,099,149 | 11/1937 | Turnquist | 52/590 |
| 2,351,768 | 6/1944 | Kaping | 52/592 |
| 4,134,241 | 1/1979 | Walton | 52/275 |
| 4,506,483 | 3/1985 | Phalen, Jr. | 52/408 |
| 4,535,579 | 8/1985 | Burgoyne et al. | 52/408 |
| 4,821,483 | 4/1989 | Adams | 52/747 |
| 4,899,514 | 2/1990 | Brookhart, Jr. | 52/553 |
| 5,133,620 | 7/1992 | Scheiwiller | 404/41 X |

FOREIGN PATENT DOCUMENTS

| | | | |
|---|---|---|---|
| 0187294A2 | 7/1986 | European Pat. Off. . | |
| 544492 | 6/1922 | France | 52/592 |
| 1709010 | 2/1970 | Germany | 52/533 |
| 622834 | 5/1949 | United Kingdom . | |

OTHER PUBLICATIONS

Roofblok™ Engineered Ballast Systems, "Roofblok 1600 Series Ballast Paver System Product Data," (1981).

"Standard Specification for Solid Concrete Interlocking Paving Units," *American Society for Testing and Materials, Annual Book of ASTM Standards,* (Mar. 1982).

*Primary Examiner*—Brian K. Green
*Assistant Examiner*—Kien T. Nguyen
*Attorney, Agent, or Firm*—Panitch Schwarze Jacobs & Nadel

[57] ABSTRACT

Roofing elements, particularly suitable for use on flat roof constructions, are provided with co-operating means on each of at least one pair of opposite side edges for co-operation with at least two adjacent elements on each of the side edges. When assembled, movement of any one element involves movement of at least one co-operating element on each of the opposite sides edges. Such bidirectional co-operation results in an interlocked roof construction wherein the uplifting of individual roofing elements by the action of the wind or other forces is substantially eliminated. Uplift pressure caused by wind passing over the roof surface can be further reduced by providing communicating air-flow passages between co-operating elements.

9 Claims, 12 Drawing Sheets

ROOFING ELEMENTS

CROSS-REFERENCE TO RELATED APPLICATION

This is a continuation of application Ser. No. 08/070,150, filed May 28, 1993, now abandoned.

BACKGROUND OF THE INVENTION

1. Field of the Invention

This invention relates generally to roofing structures and, more particularly but not exclusively, to roofing elements which co-operate with each other to provide resistance to movement, especially under windy conditions.

2. Description of the Prior Art

Roof constructions wherein a waterproof membrane is laid under or over a layer of insulation, both layers being held in place by a ballast system are well known, especially in flat roof constructions. The membrane is commonly made from rubber, plastics or some other type of waterproof material. Various techniques may be used for installing the membrane, most commonly, it is loose laid, either under or over the roof insulation. These materials are then held in place by ballast.

Frequently, flat roof structures are recessed relative to the top edge of the wall member surrounding the roof thus forming a parapet. When wind passes over the parapet, a vacuum effect along the surface of the roof is generated, the effect being particularly pronounced along the perimeter area adjacent to the parapet. This vacuum effect causes substantial uplift forces on the roof covering, and can result in uplift of the ballast material, even heavy concrete blocks.

The ballast serves a number of purposes; it acts to protect the membrane from puncturing or tearing; it helps shield the membrane from the deleterious effects of the sun's ultraviolet rays; it can prevent flame spread and damage from hot embers; but more particularly, it protects the membrane from the uplift forces which develop from naturally occurring winds.

A number of ballast systems have been used in the past, the simplest being a layer of loose laid, smooth stones. Other systems have included a layer of paving slabs or ballast blocks, or a layer of tongue and groove 'boards' made from concrete.

In general, although convenient, the use of loose stones as ballast has not proved satisfactory. The stones are liable to move about and in doing so scour the membrane surface and leave areas of the membrane exposed thereby reducing the lifespan of the membrane.

Conventional ballast blocks also have their drawbacks. As discussed above, the blocks may be subject to uplift from wind forces as well as from the freezing of any water which may lie on the roof surface. This uplift can result in rotation of the blocks, again scouring the membrane surface and exposing the membrane to the action of the weather.

Efforts to overcome the disadvantages associated with conventional ballast blocks have led to several proposals in which the ballast blocks co-operate with each other in an attempt to eliminate or reduce relative movement therebetween.

For example, U.S. Pat. No. 4,506,483 to Phalen (assignee: Roofblok Limited) discloses a roof construction comprising ballast blocks, each block having two parallel edges bevelled at substantially identical angles from the vertical, the remaining two edges being substantially vertical. In use, the blocks are laid in a specified pattern adjacent each rectangular corner of the roof so that downwardly and outwardly bevelled edges are adjacent each roof edge at the corner. Means for clipping or clamping the block edges to the deck are required.

U.S. Pat. No. 4,535,579 to Burgoyne et al (assignee: Roofblok Limited) discloses a roof construction comprising ballast blocks having the same shape as those disclosed in U.S. Pat. No. 4,506,483 referred to above, the blocks being characterised by their compressive strength, flexural strength, density and freeze-thaw cycle properties.

U.S. Pat. No. 4,899,514 to Brookhart discloses ballast blocks in the form of planar plate members, each plate member having a top and bottom surface, front and rear end portions and oppositely disposed lateral edges. The end portions co-operate in overlapping relationship with the corresponding end portions of like ballast blocks.

While the roofing elements of the prior art discussed above help to reduce the relative movement between the elements often caused by the wind or by persons needing access to the roof, for example to undertake repairs or install TV aerials, etc., the problem is not entirely eliminated. For example, it is still possible for adjacent rows of roofing elements to slide or be uplifted relative to each other. It is against this background that the present invention was devised.

SUMMARY OF THE INVENTION

Accordingly, it is an object of the present invention to provide a roofing element which is resistant to uplift pressure created by the wind. To this end, the main aspect of the present invention resides in a bidirectionally cooperating roofing element.

Thus, the present invention may also be expressed in terms of a roofing element wherein each of at least one pair of opposite side edges of said roofing element co-operates with at least two further roofing elements such that movement of the first said element necessarily involves the movement of at least one of the said further co-operating elements on each of the opposite side edges.

As will become clear, by means of the above, it is possible to overcome the disadvantages of the prior art by providing an interlocked roof construction wherein the uplifting of individual roofing elements by the action of the wind or other forces is at least substantially eliminated. This is because each individual roofing element is restricted from moving independently of at least two other roofing elements, these other roofing elements are in turn restricted from moving by further elements, and so on. The result is a multiplication of the force acting in opposition to the uplifting force of the wind.

In its simplest form, the roofing element of the present invention preferably comprises a body wherein each side edge of at least one pair of opposite side edges of said body is provided with means for co-operating with at least two further roofing elements.

The co-operating means may be of any convenient form, for example, in the form of overlapping means, interengaging means or interlocking means. For ease of manufacture and assembly, it is preferred to use simple overlapping means. The overlapping means may be in the form of projections which co-operate with recesses. Preferably, the projections are in the form of wings extending from opposite side edges of the body. More preferably, the base of each projection lies flush with the lower surface of the body and the upper surface of each projection lies below the upper surface of said body.

The recesses generally lie below the upper surface of the body and are such that they are able to receive the projections of adjacent roofing elements when in use. In a preferred embodiment, the recess begins at the lower surface of the body and ends beneath the upper surface of said body.

A preferred roofing element in accordance with the invention comprises a body wherein each of two opposite side edges are provided with at least one projection and at least one recess. The body is preferably rectangular in shape, with a top and bottom surface, two substantially parallel side edges and each of the two remaining side edges having at least one projection and at least one recess.

Advantageously, each of the two opposing side edges is provided with a single elongate projection in the form of a wing and a single recess for receiving a projection of an adjacent roofing element. In a preferred embodiment, each wing extends from one end of the side edge towards the middle of the side edge, with the recess extending from the opposite end of the side edge towards the projection.

Manufacture of the roofing elements is facilitated when the projection along the one side edge is located directly opposite the projection on the other side edge. When the projections are in the form of wings this results in a roofing element which is generally T-shaped in plan view. Further manufacturing advantages can be gained by tapering the foremost edges of the projections towards the edges of the body. Moreover, the edges of the projections are preferably bevelled to ease the introduction of the projections into the recesses; similarly the contours of the recesses may also be bevelled.

A roofing element wherein the projection on one side edge is located directly opposite the recess on the opposite side edge may also be used, but in these circumstances it is preferable to use such elements in straight bond between a row of elements which have their projections and recesses directly opposite each other as described above.

Alternatively, or in addition thereto, the projections may be centrally located along opposite side edges with recesses provided on either side of each projection such that the roofing element is generally cross-shaped in plan view. Conversely, the recesses may be centrally located along opposite side edges with projections provided on either side of each recess such that the roofing element is generally I-shaped in plan view.

It is further possible to provide co-operating means on more than two of the side edges of each roofing element, in particular, in the case of a generally rectangular body, all four sides may be provided with the same. However, for simplicity of laying the elements on the roof surface, it is preferred that only one pair of opposing side edges is provided with said co-operating means.

Advantageously, the roofing element comprises a generally rectangular body having a top and bottom surface, two substantially parallel side edges, each of the remaining two side edges having one wing and one recess for receiving a wing of an adjacent element, wherein by means of the said wings and recesses the said roofing element is in use in bidirectional co-operation with four adjacent elements.

In a preferred embodiment, each roofing element comprises a generally rectangular body having a top and bottom surface, two substantially parallel side edges, each of the remaining two side edges having (i) a single elongate projection extending from one end of the side edge, the base of the projection lying flush with said bottom surface of said body and the upper surface of the projection lying below the top surface of said body, and (ii) a single elongate recess extending from the opposite end of the side edge and being adapted to receive and co-operate with an elongate projection on an adjacent element.

With the preferred arrangement above, the roofing elements when assembled on a roof or other flat or inclined surface provide a substantially continuous surface shielding the surface beneath from the weather and, more importantly, the said roofing elements bidirectionally co-operate with each other in such a way that movement between the elements is at least substantially eliminated. Furthermore, the arrangement of the assembled elements is such that the need for clips or clamping means is dispensed with.

Uplift pressure on roofing elements caused, for example, by wind passing over a parapet can be further reduced by providing a source of air which can drawn upon to bring the air pressure above the roofing elements back to or approaching normal atmospheric pressure.

From a further aspect, it is an object of the present invention to provide a means of controlling the flow of air from an area occupied by a plurality of co-operating roofing elements to the atmosphere above said roofing elements by providing said co-operating roofing elements with communicating air-flow passages.

Expressed in another way, it is an object of the present invention to provide a means for increasing lowered air pressure above a roof surface wherein a plurality of roofing elements co-operate to provide communicating air-flow passages from which air can be drawn into the area of lowered air pressure.

In a preferred embodiment, the air-flow passages communicate to provide a bidirectional flow of air. In this way, air can be drawn from two different directions allowing a rapid flow of air into the area of low pressure created above the roof surface by the wind.

The provision of communicating air-flow passages can be achieved by means of spacer members on the bidirectionally co-operating roofing elements described herein above. One or more spacer members may be provided on each roofing element. When each roofing element is in the form of a generally rectangular body, it is preferred to position a spacer element on at least one side edge of each pair of opposing side edges.

More preferably, when the co-operating means of the roofing elements are in the form of projections and recesses, the spacer members may be provided on either the projections or the recesses or both. In addition to the optional spacer members on the co-operating means, further spacer members may be provided on one or more of the other side edges of the body thereby permitting bidirectional flow of air through the roofing elements. While the shape of the spacer members is not critical, when provided on the projections they are preferably in the form of secondary elongate projections, and when provided on the side edges they are preferably in the form of lugs.

Furthermore, in order to optimise the benefits of the spacer members and permit the rapid flow of air from the air-flow passages to the area above the roof surface, it is preferred that the spacer members extend only partially along the lengths of the side edges or projections. In this way, when an area of negative pressure is created above the roof surface, air can be drawn up through the gaps created between the roofing elements by the spacer members.

The bottom surface of the roofing element may be substantially flat, but in a preferred embodiment is contoured in such a way that the amount of material used to form the element is reduced without compromising on the overall strength. This is most advantageously achieved when the thickest part in cross-section is at or around the centre of the roofing element. At the optimum cross-section, the flexural strength of the element is increased relative to the compressive strength such that when the element is made from a concrete mix it is possible to reduce the cement content without penalty.

The bottom surface may be continuous or may be provided with one or more open-bottomed channels. Preferably, the channels are in communication with the aforementioned air-flow passages. The provision of channels enables a greater volume of air to be drawn to 'neutralise' the area of low pressure which may form above the roof surface. Alternatively, a plurality of 'pads' may be provided on the bottom surface to raise the underside of the roofing element above the roof surface to allow air to flow freely beneath the element.

In order to insulate the membrane underneath the layer of roofing elements of the invention, a layer of insulation is advantageously positioned between the membrane and the said layer of roofing elements. The insulation may be made from any conventional insulating material, but foam is the preferred material, especially closed-cell foam. Conveniently, the insulating material is attached to the underside of each of the roofing elements before the element layer is assembled. As well as insulating the membrane beneath the layer of roofing elements, the provision of a foam backing on the roofing elements allows a softer surface to be in contact with the membrane further reducing the wear and tear on it.

To maximise the thermal value of the system, it is preferred that the insulation on the underside of each of the roofing elements abuts the insulation on the neighbouring elements so that there is a substantially continuous layer of insulation next to the roof membrane. More preferably however, spacer elements are provided on the underside of the insulating material so that a gap is left under the insulation to allow water to drain across the surface of the membrane.

As with the underside of the roofing element, air-flow ducts or channels may also be provided on the insulation. The air-flow channels are preferably provided on the upper surface of the insulation and are in open communication with corresponding channels on the underside of the body of the roofing element to which the insulation is attached.

The roofing elements of the present invention can be manufactured by any convenient method. The elements may for example be formed by extrusion or by pressing. One example of suitable apparatus for use in producing the said elements is the Besser plain pallet machine. Another example involves the use of a conventional roof tile partial extrusion machine.

The Besser machine is a cam operated block production machine having vibration means for filling the moulds and compressing the block product. In operation, the material used to make the blocks is transferred from a storage hopper into a feed box from where the material is then fed with the assistance of vibration into a mould. A stripper head is rotated into a position on top of the material and this, together with the vibration, acts to compress the material in the mould to form the block product. Once formed, the mould is brought to rest on a plain steel pallet where the block product is then held and from where the product is taken by means of mechanical arms and/or conveyors to other handling equipment.

Roof tiles have been produced by extrusion for over forty years with conventional apparatus including a hopper-like box which is disposed above a conveyor path and which is charged with a cementitious mixture. The flow of the cementitious mixture is assisted in the box by means of a rotating paddle disposed therewithin. A succession of pallets for moulding the undersurface of the tiles is driven along the conveyor path and beneath the box so that the cementitious mixture forms on the pallets and is compressed therein by means of a rotating roller disposed within the box downstream of the paddle and having a contour which corresponds to the upper surface of the tiles to be formed.

The cementitious mixture is further compressed on the pallets as they pass out of the box by means of a slipper which is disposed downstream of the roller and also has a contour which corresponds to that of the upper surface of the tile to form a continuous extruded ribbon of cementitious mixture on the pallets. The ribbon is subsequently cut into tile forming lengths downstream of the box by means of a suitable cutting knife and the pallets with the formed tiles thereon are conveyed to a curing location.

It should also be appreciated that the invention from a further aspect resides in a roof construction comprised of a plurality of bidirectionally co-operating roofing elements as defined herein above.

Furthermore, and from yet another aspect, the invention resides in a method of constructing a roof whereby a plurality of bidirectionally co-operating roofing elements as defined herein above are assembled together such that each of said elements is prevented from moving independently of at least two other co-operating elements.

The invention also resides in a method of controlling the air pressure above a roof surface whereby a plurality of co-operating roof elements as herein defined above are assembled together to provide a bidirectional flow of air through said roofing elements.

BRIEF DESCRIPTION OF THE DRAWINGS

The foregoing summary of the invention, as well as the following detailed description of the preferred embodiments, will be better understood when read in conjunction with the following drawings. For the purpose of illustrating the invention, there are shown in the drawings embodiments which are presently preferred, it being understood, however, that the invention is not limited to the specific arrangements disclosed.

DESCRIPTION OF THE PREFERRED EMBODIMENTS

Figure 1:
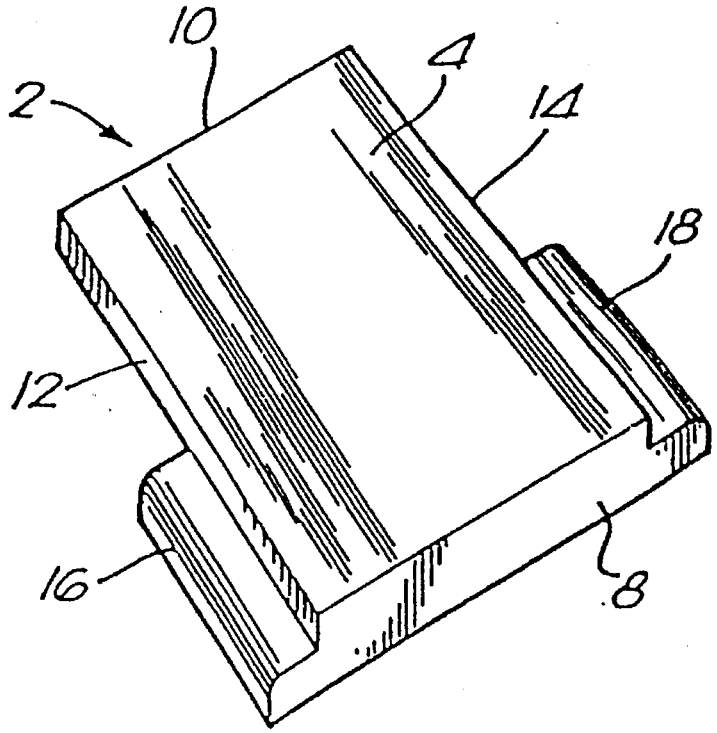
FIG. 1 is a perspective view from above of a roofing element according to the invention.
Figure 2:
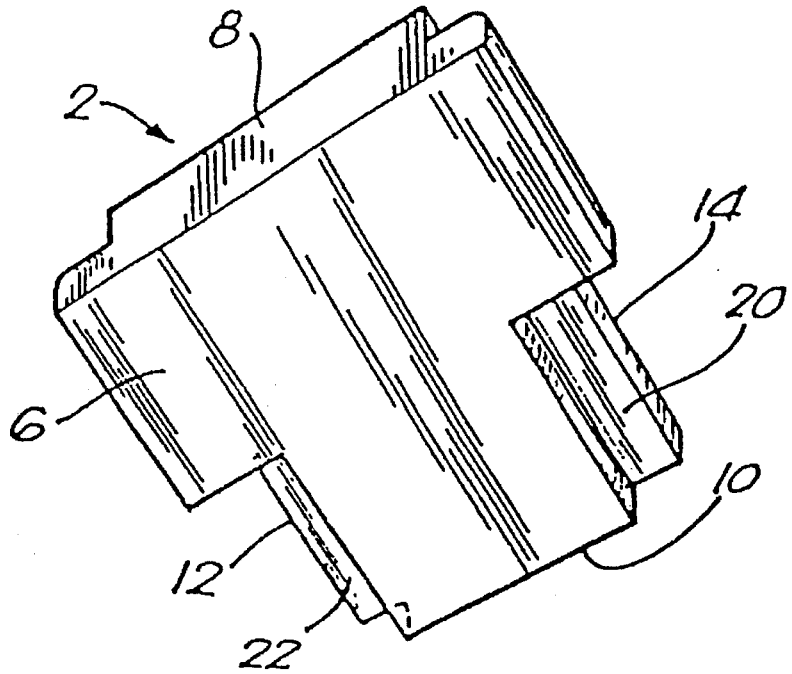
FIG. 2 is a perspective view from below of the roofing element of FIG. 1.
Figure 3:
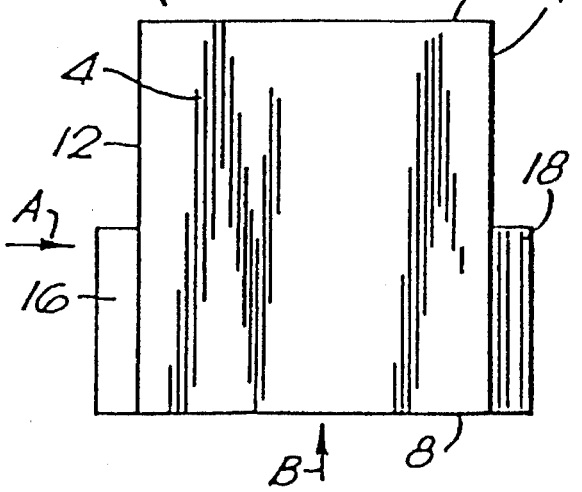
FIG. 3 is a plan view from above of the roofing element of FIG. 1.
Figure 4:
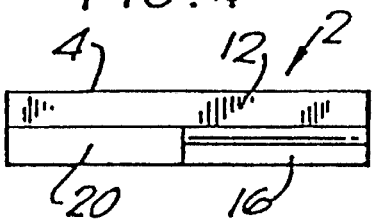
FIG. 4 is a side view of the roofing element of FIG. 3 from direction A.
Figure 5:
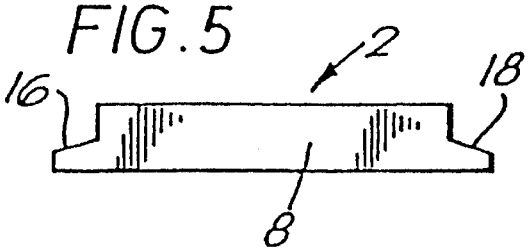
FIG. 5 is a side view of the roofing element of FIG. 3 from direction B.
Figure 6:
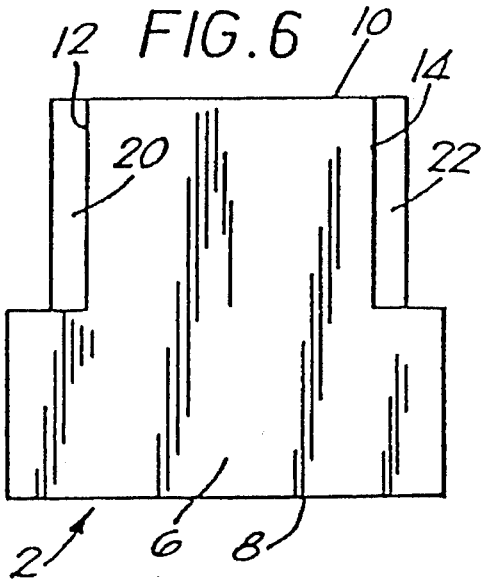
FIG. 6 is a plan view from below of the roofing element of FIG. 1.

Referring firstly to FIG. 1, a roofing element 2 is of a generally rectangular, planar structure having an upper surface 4 and a lower surface 6 (not shown). The element 2 has two substantially parallel side edges 8, 10. Each of the other two side edges 12, 14 being provided with a projection 16, 18 for co-operating with a complimentary recess on an adjacent element. The elongate edges of the projections 16, 18 are bevelled providing smooth contours which ease introduction of the projections 16, 18 into the recesses of adjacent elements. A recess 20, 22 is provided along each of the same edges 12, 14 as are provided with projections and can be clearly seen in FIG. 2. Plan and side views of the same roofing element can be seen in FIGS. 3 to 6.

Figure 7:
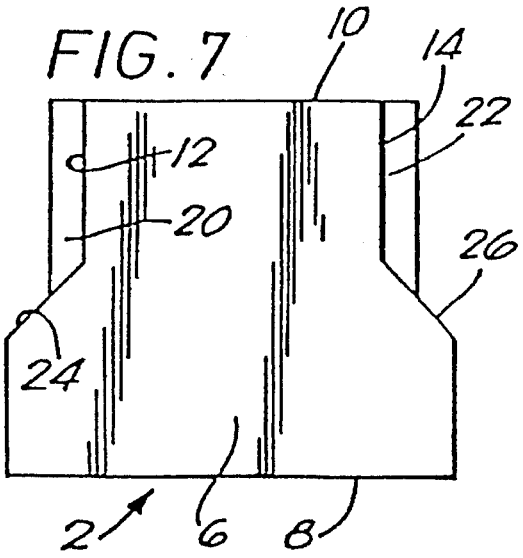
FIG. 7 is a plan view from below of a preferred roofing element.
Figure 8:
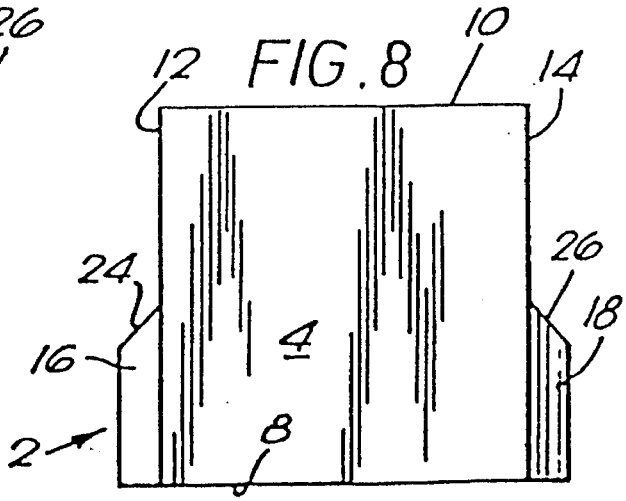
FIG. 8 is a plan view from above of the roofing element of FIG. 7.

FIGS. 7 and 8 are plan views, from below and above respectively, of a roofing element 2 in which the ends 24, 26 of the projections 16, 18 are tapered towards the edge 12, 14 of the body. The provision of these tapered portions facilitates the manufacture of the elements by moulding.

Figure 9:
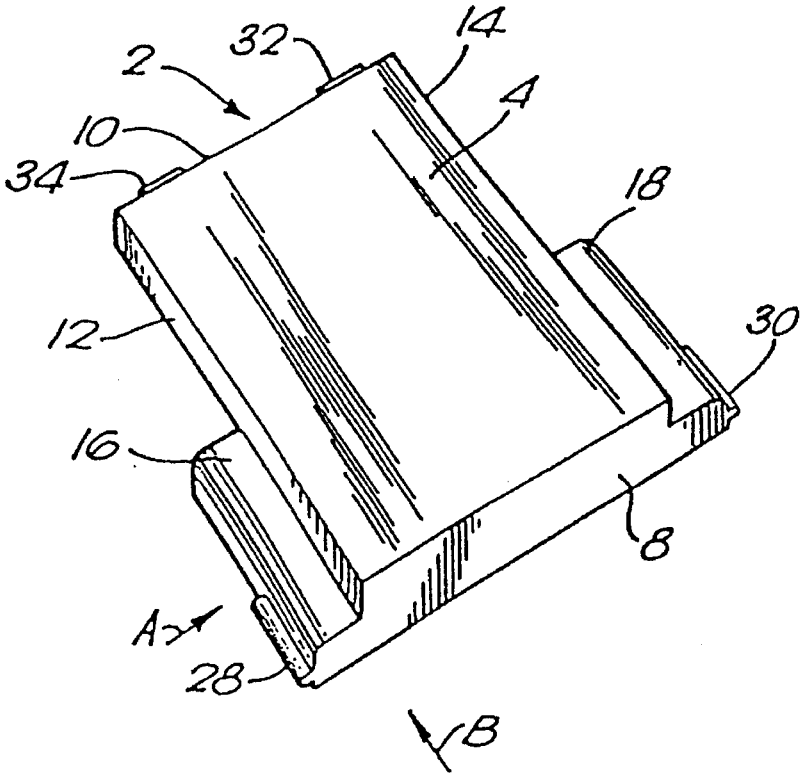
FIG. 9 is a perspective view from above of a roofing element having spacer members.
Figure 10:
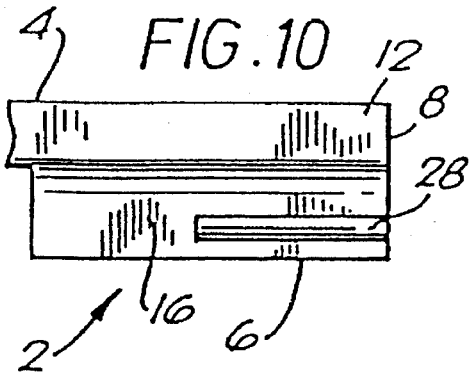
FIG. 10 is a side view of the roofing element of FIG. 9 from direction A.
Figure 11:
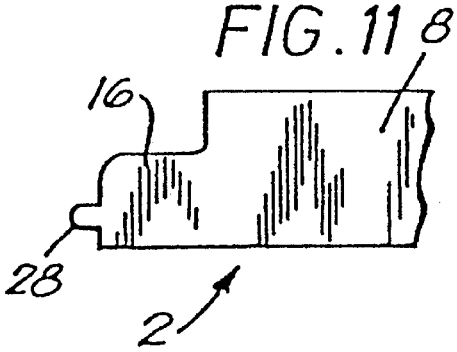
FIG. 11 is a side view of the roofing element of FIG. 9 from direction B.
Figure 12:
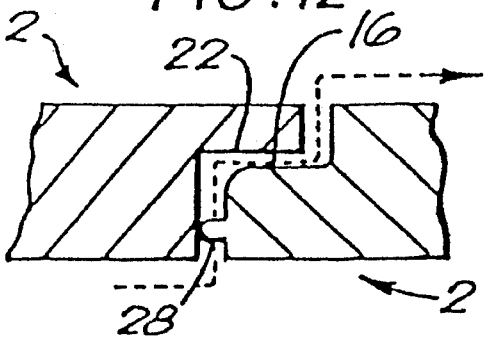
FIG. 12 is a side view of a pair of roofing elements of the type shown in FIG. 9 in actual use.
Figure 13:
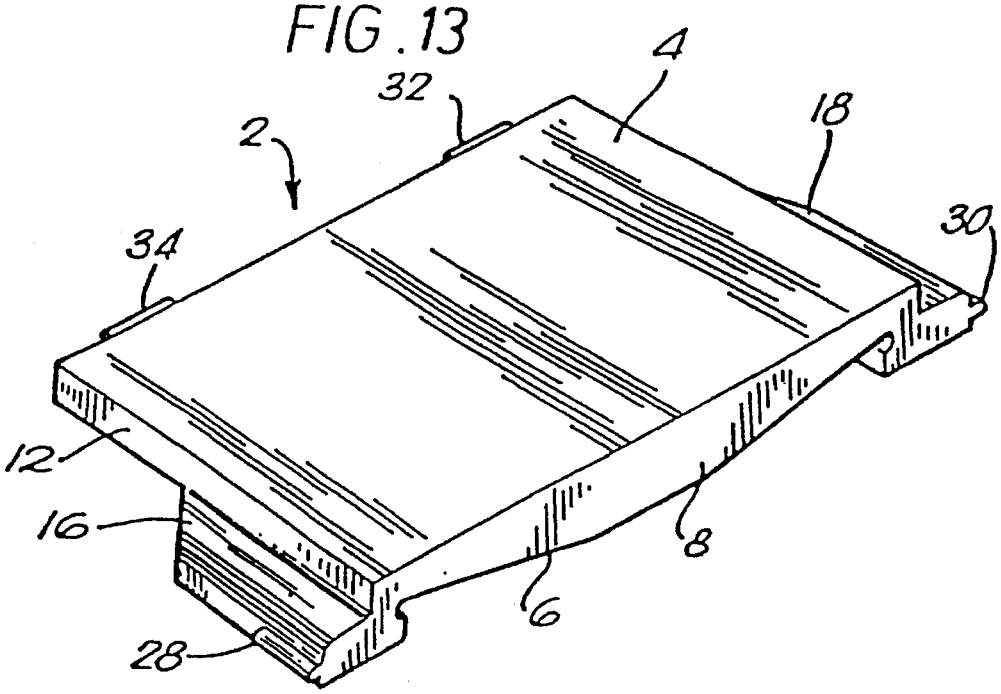
FIG. 13 is a perspective view from above of a preferred roofing element in accordance with the invention.
Figure 14:
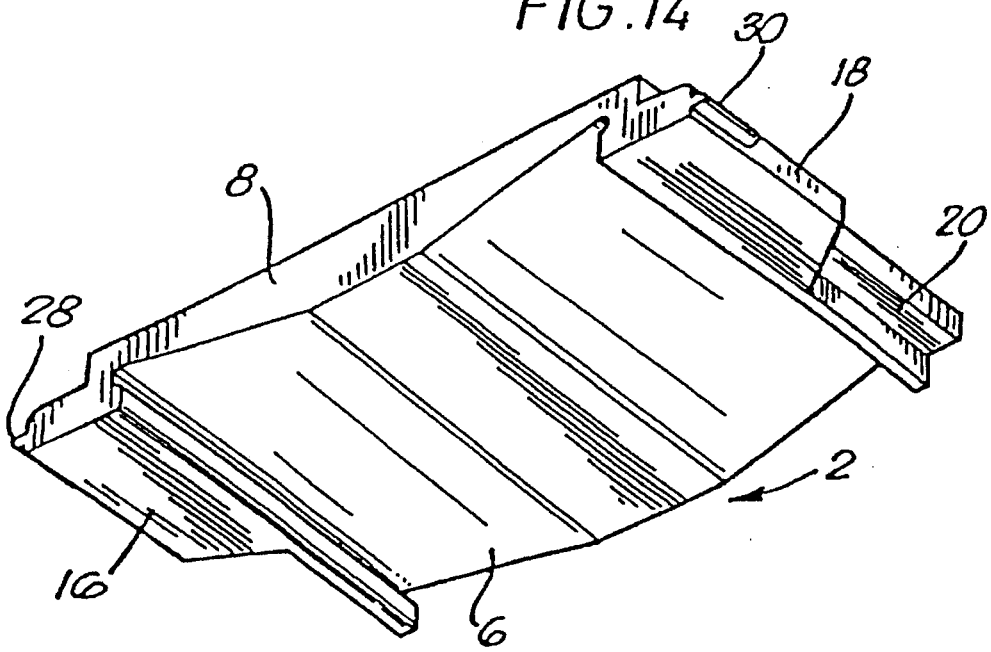
FIG. 14 is a perspective view from below of the roofing element of FIG. 13.

In FIG. 9, spacer members 28, 30 are provided on each of the projections 16, 18 and lugs 32, 34 are provided on one of the parallel side edges 10. These spacer members 28, 30 and lugs 32, 34 create air-flow passages providing a source of air which can then be drawn to 'neutralise' areas of low pressure formed by the rush of wind across the roof surface. These air-flow passages also ensure the area beneath the layer of roofing elements is well ventilated. FIGS. 10 provides a side elevation of the roofing element 2 of FIG. 9 from direction A; FIG. 11 is a side elevation from direction B; and FIG. 12 is a side elevation of a pair of roofing elements in co-operation with each other, the arrow showing the direction of air flow through the passage created by the spacer member. FIGS. 13 and 14 are perspective views from above and below respectively of a particularly preferred form of roofing element 2 in which the lower surface 6 is contoured to reduce the amount of material required to produce the element whilst at the same time achieving excellent flexural strength. Once again, the contoured roofing element 2 may be easily manufactured by moulding or pressing.

Figure 14A:
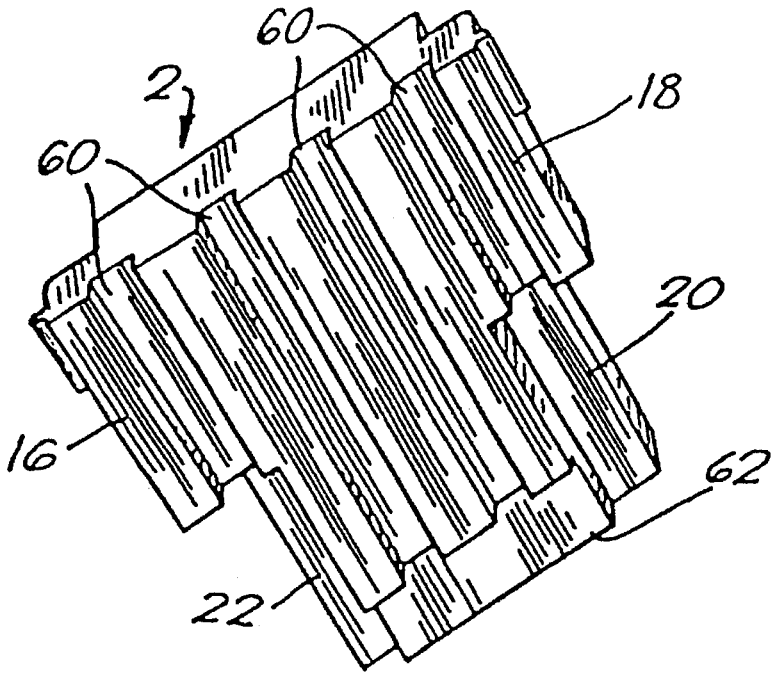
FIGS. 14A and 14B are perspective views from below of alternative forms of roofing elements.
Figure 14B:
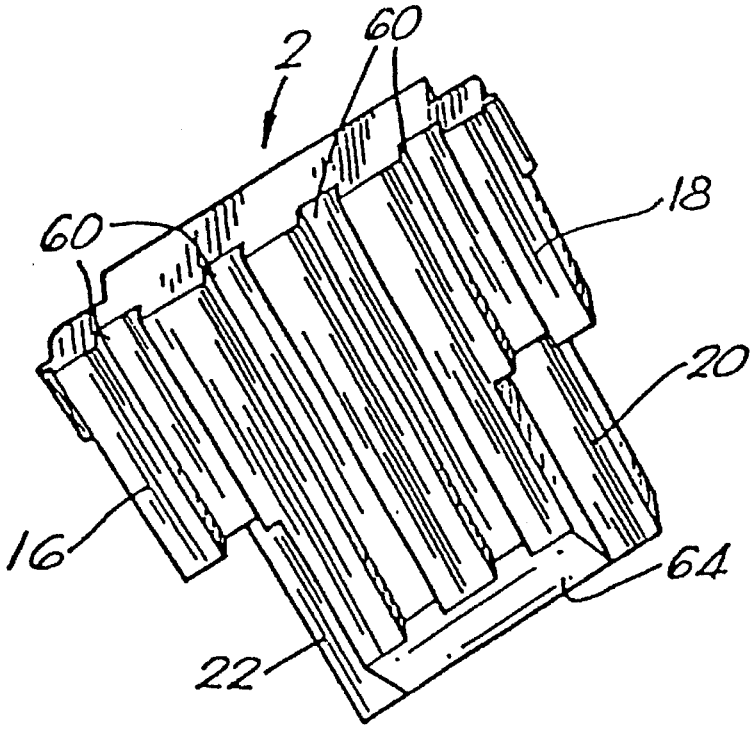

FIG. 14A shows a roofing element similar to that shown in FIG. 9 except open-bottomed channels 60 and a cut-out 62 are provided on the underside to increase the volume of air available to flow into the air-flow channels created by the spacer members. The presence of these channels has little effect on the overall strength of the roofing element, the underside of the projections 16, 18 and the central portion of the underside of the body providing sufficient support for any weight placed on the upper surface of the roofing element. In FIG. 14B, the cut-out is in the form of a taper 64.

Figure 15:
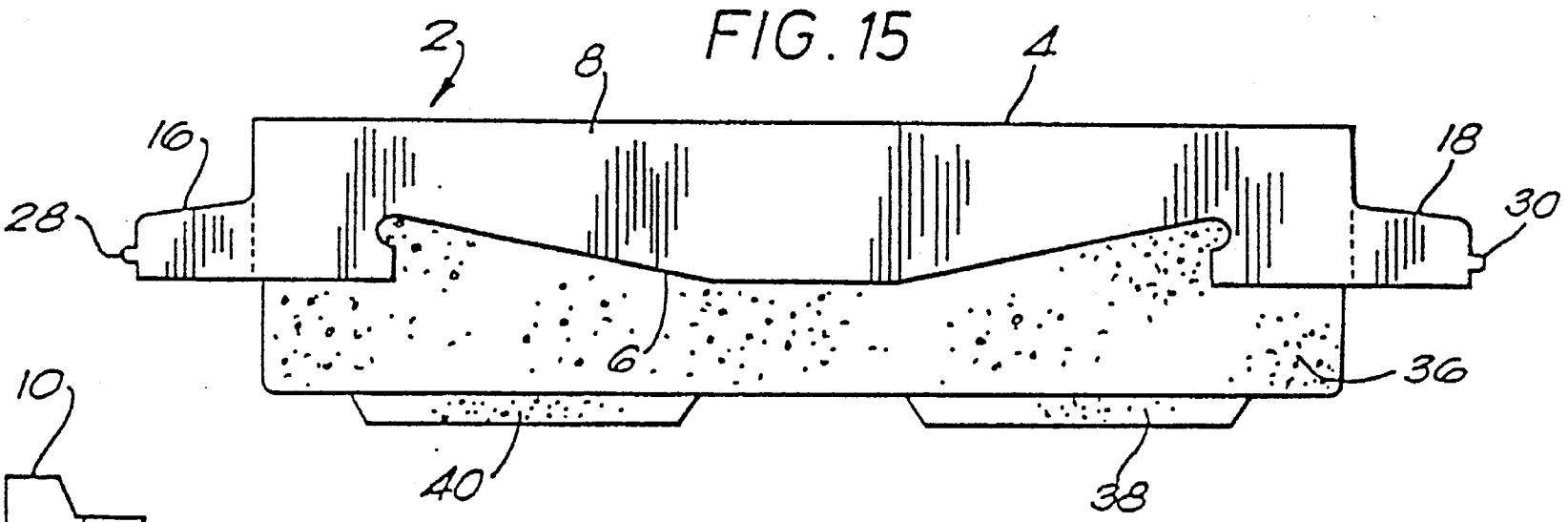
FIG. 15 is a side view of the roofing element of FIG. 13 with foam backing.

FIG. 15 is a side view of a roofing element 2 in accordance with FIGS. 13 and 14 but with the addition of foam backing 36 attached to the contoured underside surface 6. As mentioned above, the foam backing 36 is most preferably of a closed cell structure. The foam backing 36 illustrated is also provided with spacer members 38, 40 to allow any water which penetrates through the system to drain across the surface of the membrane.

Figure 15A:
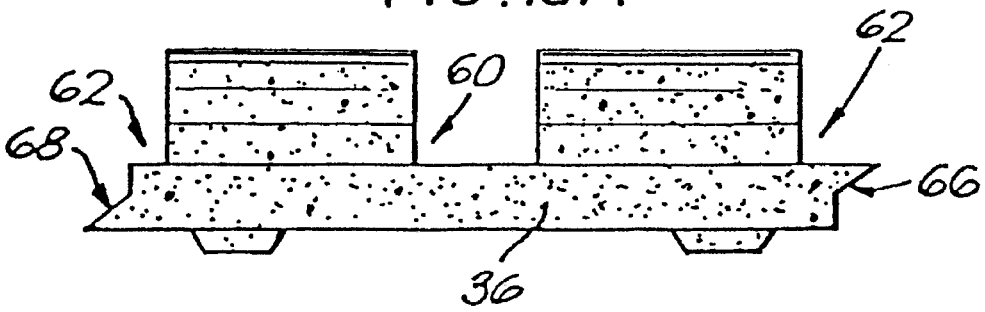
FIGS. 15A, 15B and 15C are side and perspective views of an alternative arrangement of foam backing.
Figure 15B:
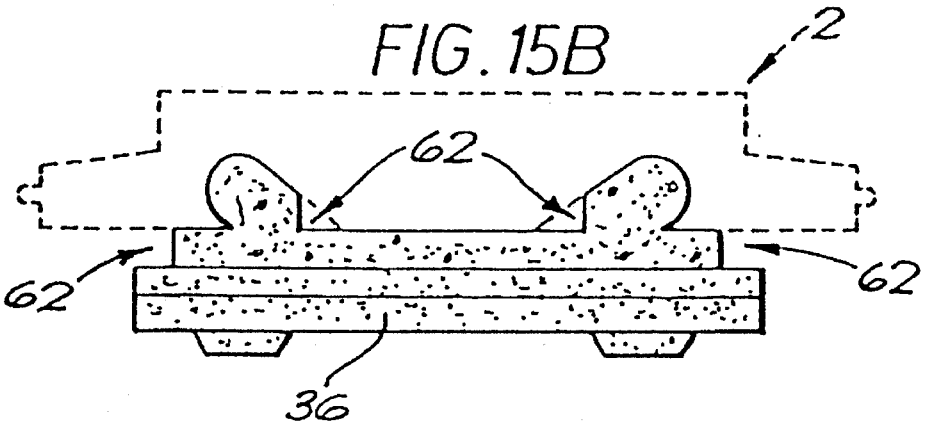
Figure 15C:
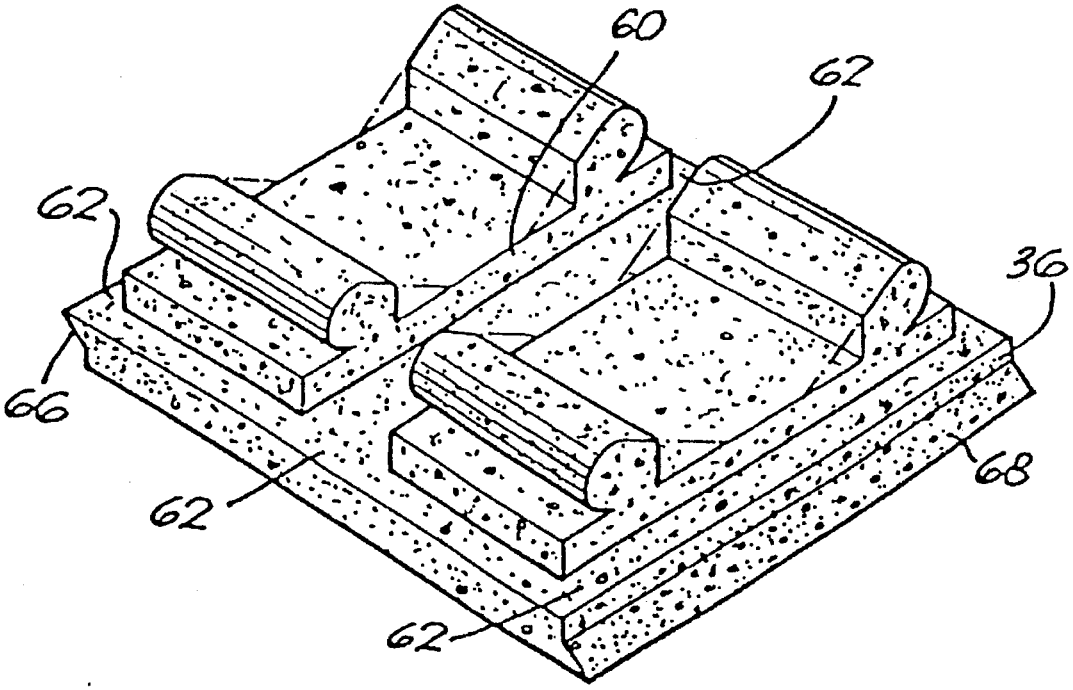

FIGS. 15A, 15B and 15C are side and perspective views of an alternative form of foam backing 36, the upper surface of which is shaped to co-operate with the undersurface of a roofing element. Channels 60 and cut-outs 62 are provided in the foam to allow the flow of air into the air-flow passages created by the spacer members. Such a network of channels and cut-outs enhances the bidirectional air-flow provided by the spacer members of the roofing elements. In order to maximise the benefits of the insulation by keeping the foam backing on adjacent elements in abutment, an overhang 66 and an undercut 68 are provided on at least one pair of opposing side edges towards the base of the foam backing, each co-operating in use with an undercut and overhang respectively on an adjacent element. Of course, the undercut and overhang are not restricted to the shape shown in the drawings, for example they could simply be generally rectangular in cross-section. The dashed line of FIG. 15B shows an example of a type of contoured roofing element co-operating with the foam backing.

Figure 16:
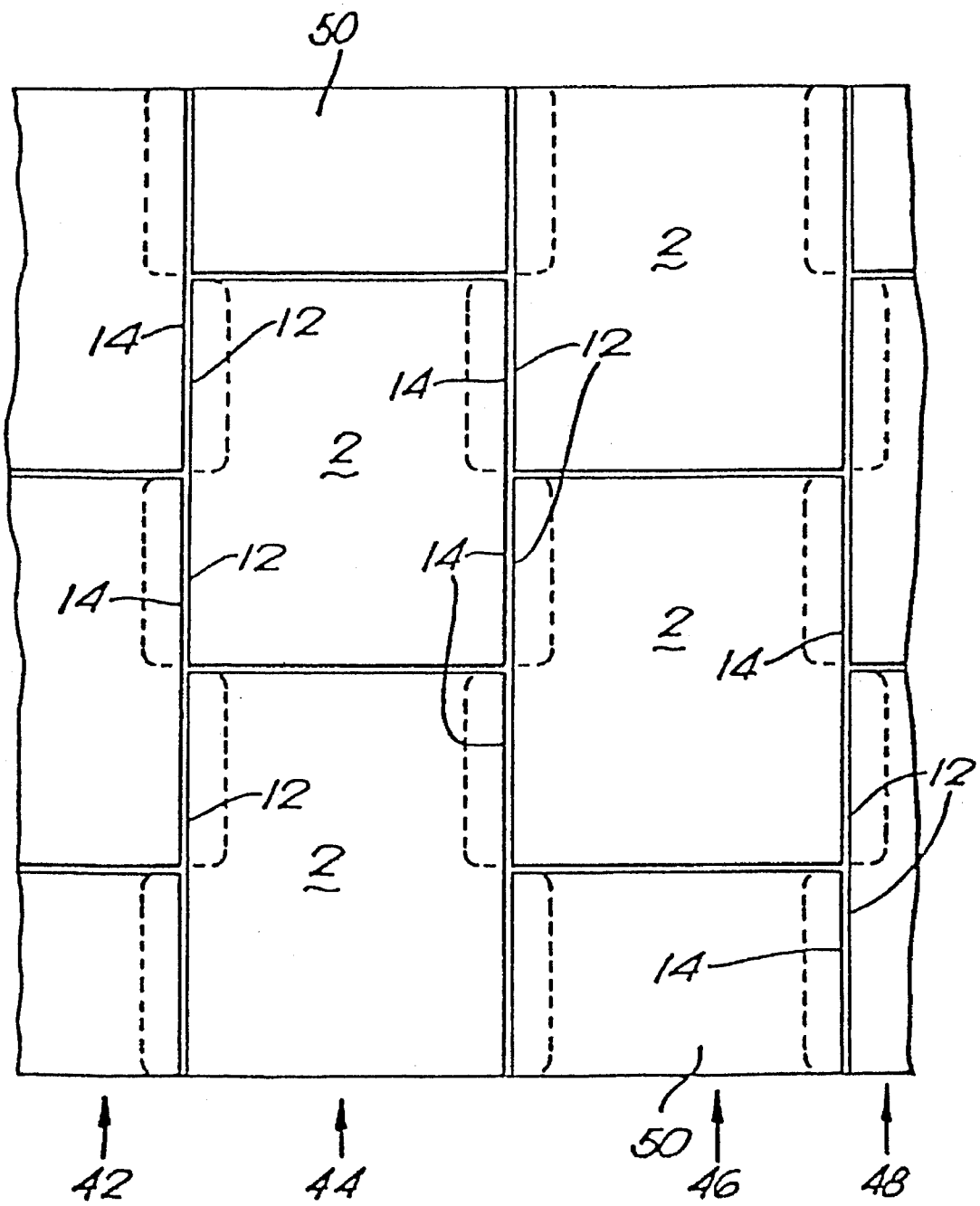
FIG. 16 is a plan view from above of a roof construction in accordance with the invention.

FIG. 16 is a plan view of a roof construction in accordance with the invention. The broken lines show the co-operating regions below the upper surface of the elements 2. The roofing elements 2 co-operate in such a way that adjacent rows 42, 44, 46, 48 are off-set relative to each other. At the end of each alternate row a half-element 50 is used so that a straight edge is formed. As will be appreciated from the drawing, the arrangement of projections and recesses means that the roofing elements 2 are restricted from moving relative to each other both laterally (east-west) and longitudinally (north-south). More especially, because opposite side edges 12, 14 of each roofing element 2 are in co-operation with other elements 2, and those other elements are in turn in co-operation with further elements, the upward force on any individual element 2 caused for example by the wind blowing across the surface is spread across the entire roofing structure. This effect makes it very difficult, if not impossible, for individual elements to be lifted up through the action of the wind. When spacer elements are also present, the distance between each roofing element is enlarged so that air can flow bidirectionally between the individual elements and up through the gaps thereby offsetting any areas of low pressure caused by the wind.

Figure 17:
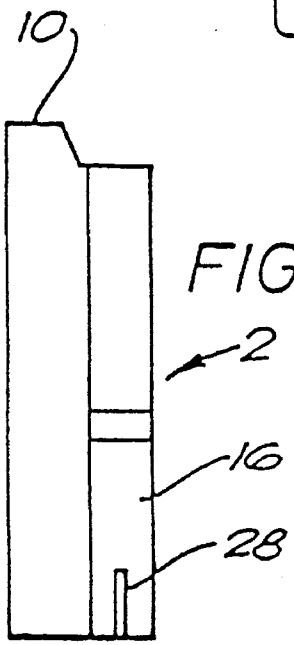
FIG. 17 is a side view of a block machine roofing element as it emerges from a Besser machine.

FIG. 17 is a side view of a roofing element as it would emerge from a block machine, such as a Besser machine. In the drawing referred to, the side edge 10 is profiled to provide a greater gap between the elements when in the laid configuration.

Figure 18:
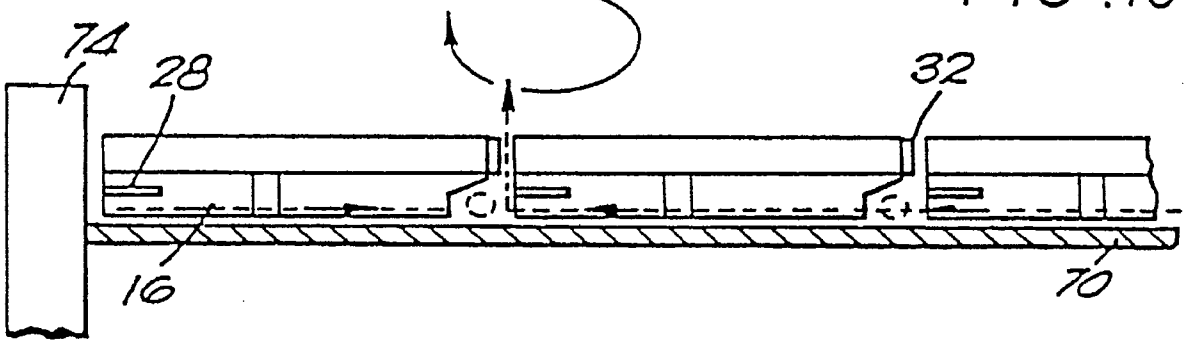
FIG. 18 is a side view of a row of roofing elements laid across a roof membrane.

FIG. 18 is a side view showing several block machine products laid on a roof surface above a membrane 70. The roof surface is recessed relative to parapet 74. When wind rushes over the parapet above the roof surface, an area of low pressure is created producing a suction effect on the roofing elements. However, because of the air-flow passages between the elements formed by the lugs 32 and spacer members 28 on each of the side edges, air is drawn bidirectionally along the passages and out through the gaps into the area of low pressure above the roof surface. By such means, the upward pressure on the elements caused by the wind is substantially reduced. The horizontal dashed lines on FIG. 18 show the air flow in one direction, the dashed circles between the elements show the air flow in a direction normal to the first direction, and the vertical dashed line shows the air flow up and out into the low pressure area.

Figure 19:
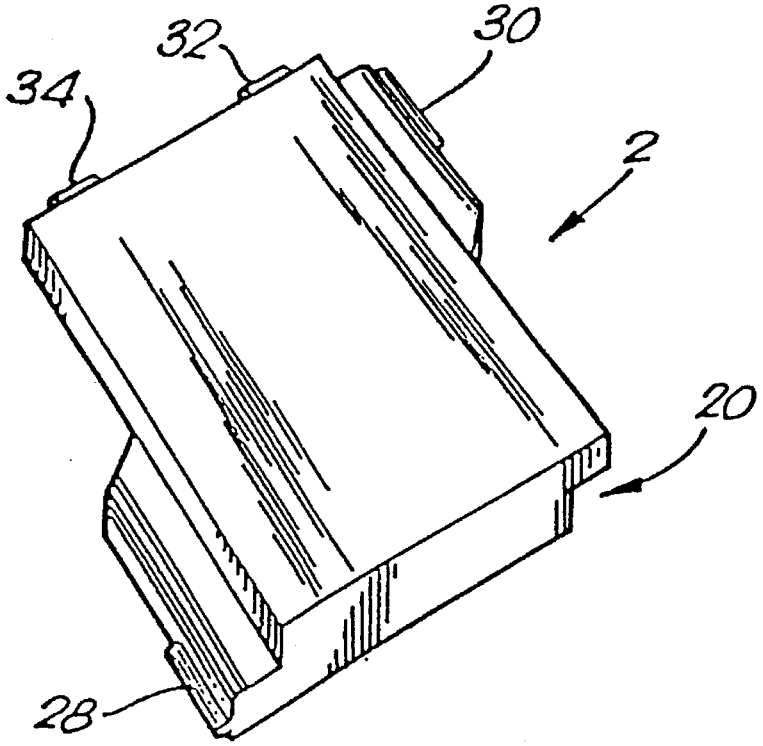
FIG. 19 is a perspective view from above of a further form of roofing element.
Figure 20:
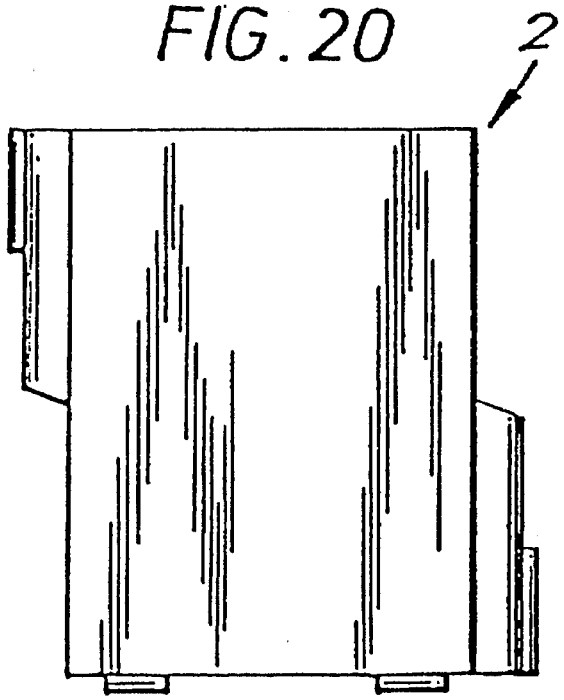
FIG. 20 is a plan view from above of the roofing element of FIG. 19.
Figure 21:
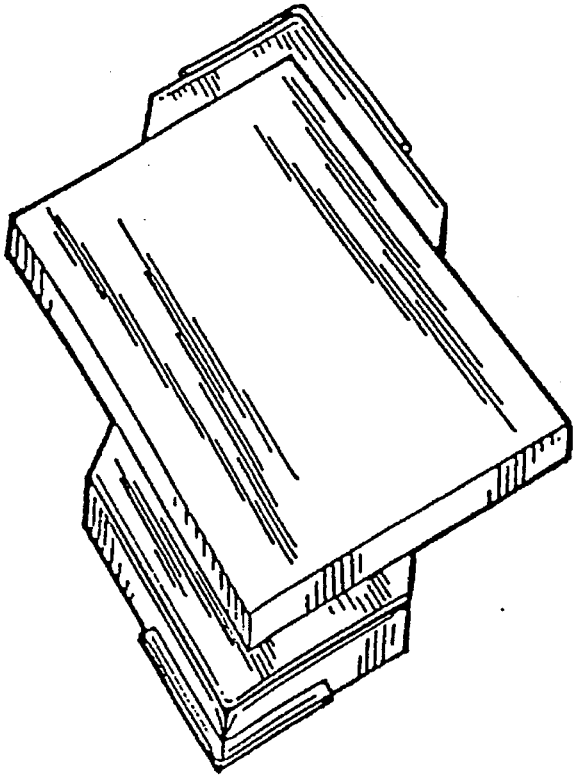
FIG. 21 is a perspective view from above of another form of roofing element.
Figure 22:
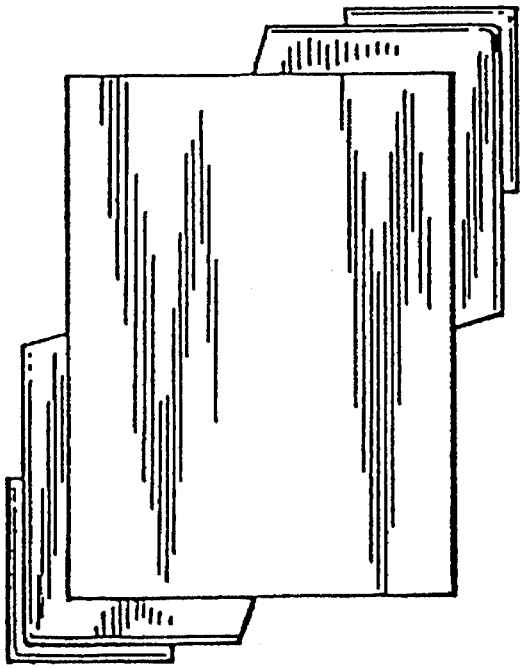
FIG. 22 is a plan view from above of the roofing element of FIG. 21.

FIGS. 19 and 20 show a roofing element where the projections are opposite recesses. Such a roofing element is preferably used in conjunction with the roofing elements of FIG. 9. In particular, the roofing elements of FIGS. 19 and 9 would be used in alternate rows. FIGS. 21 and 22 on the other hand show a roofing element where each of the four side edges are provided with a projection and a recess. In the latter case the need for lugs is rendered superfluous.

Figure 23:
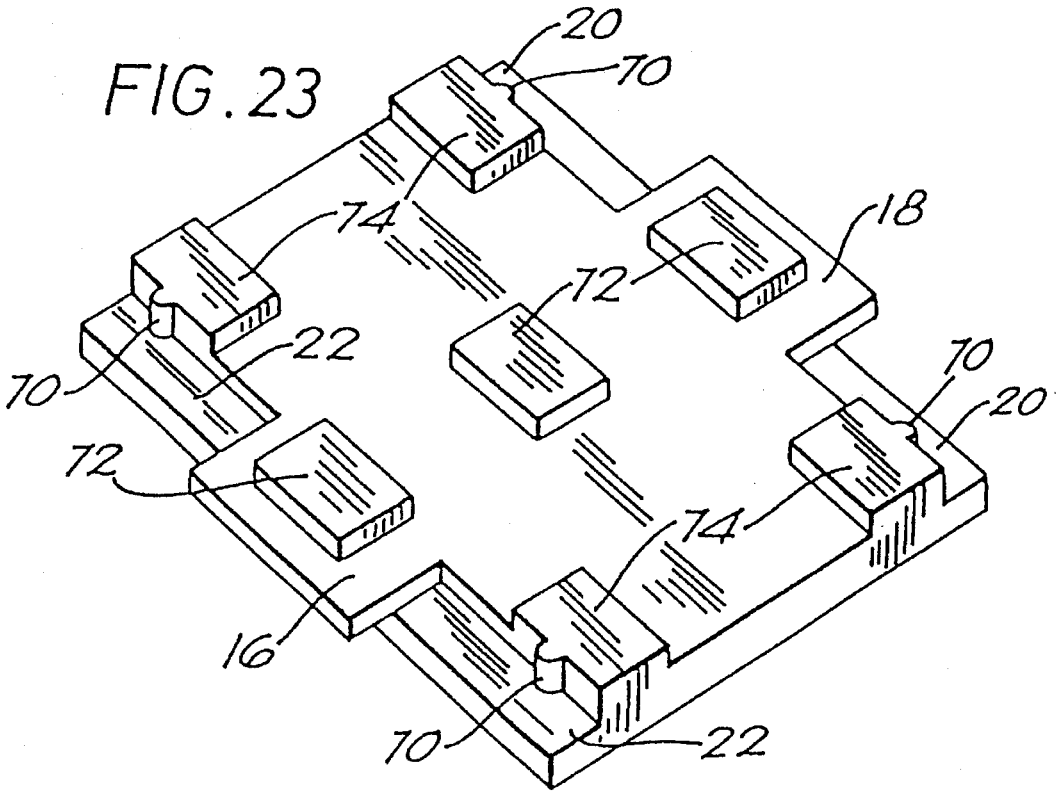
FIGS. 23 and 24 are perspective views from below and above respectively of a yet further form of roofing element.
Figure 24:
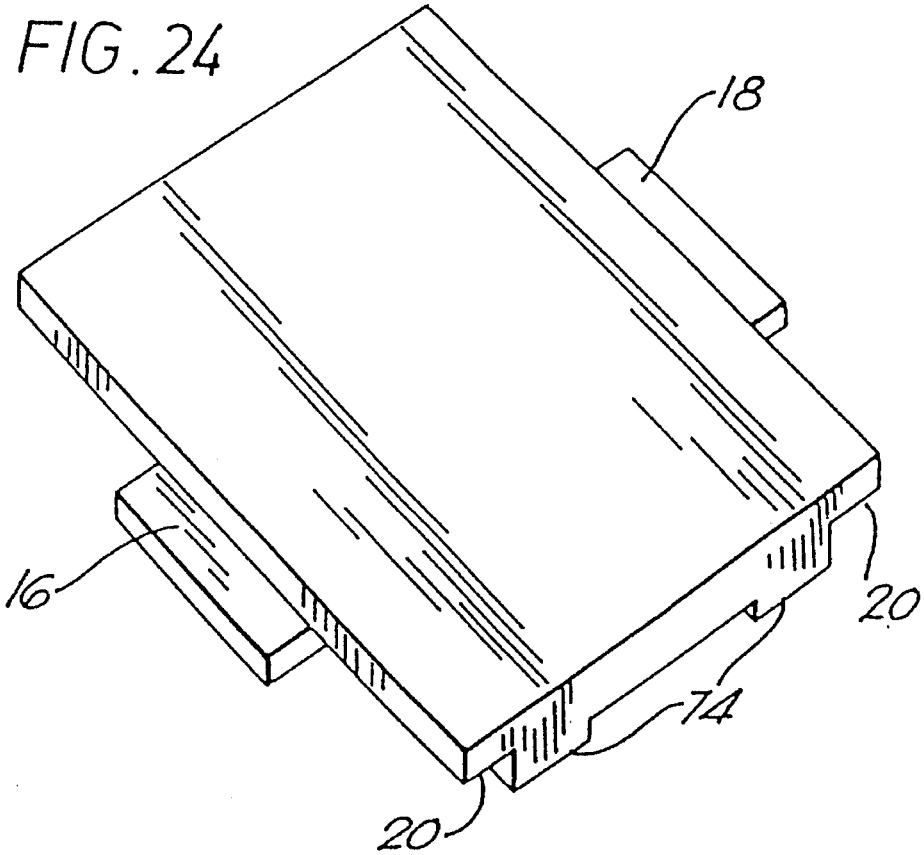

The present invention may be embodied in other specific forms without departing from the spirit or essential attributes thereof and, accordingly, reference should be made to the appended claims, rather than the foregoing specification as indicating the scope of the invention. For example, FIGS. 23 and 24 show a roofing element where the projections 16, 18 are centrally located along opposite side edges with recesses 20, 22 on either side of each projection. As can be seen from FIG. 24 the roofing element is generally cross-shaped in plan view.

Figure 25:
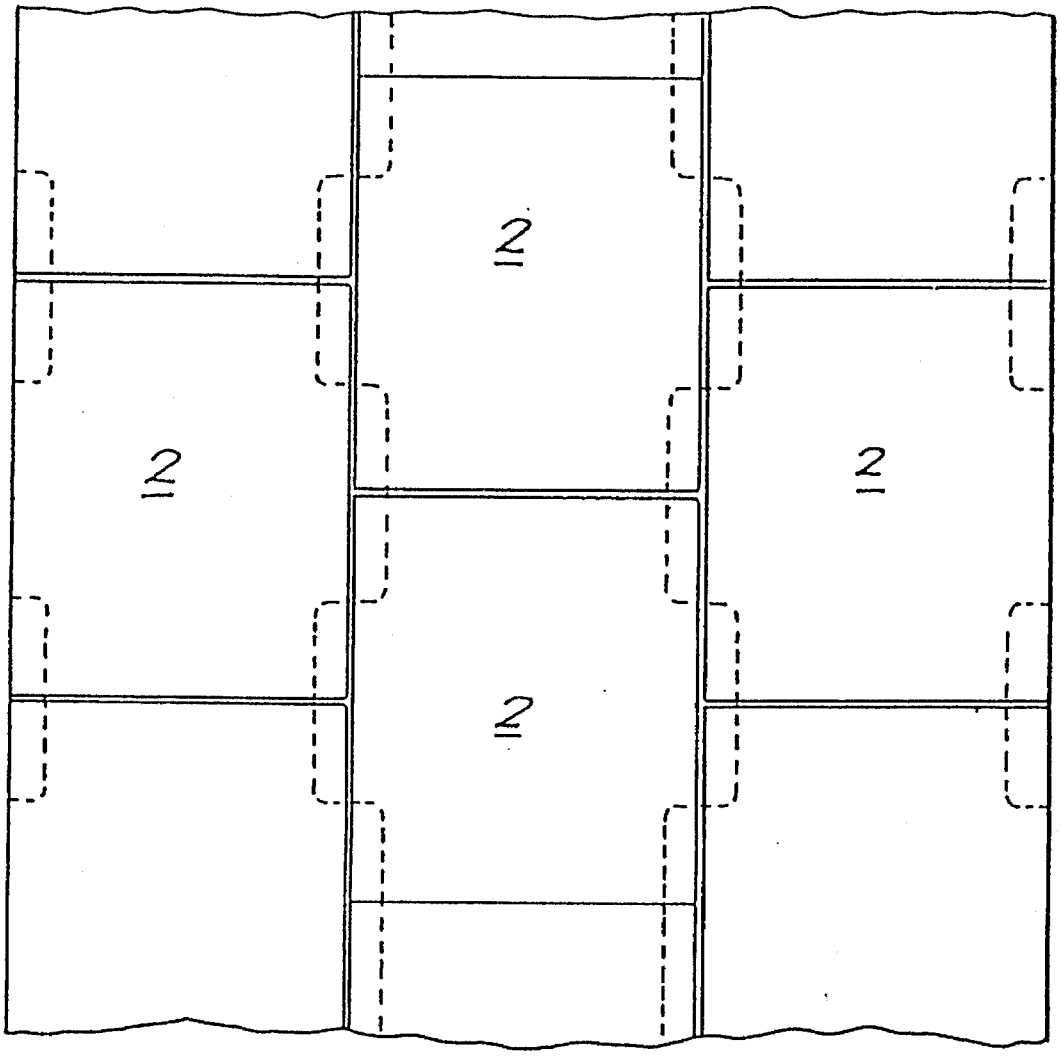
FIG. 25 is a plan view from above of a roof constructed from elements of FIGS. 23 and 24.

A number of pads 72, 74 are provided on the underside of the element so that when installed on a roof structure, air can be drawn from several directions. Spacer members 70 are provided on each of the side walls of the recesses 20, 22, but instead of lying parallel to the body of the element as previously illustrated, they are normal to the body of the element. FIG. 25 is analogous to FIG. 16, showing a roof constructed from roofing elements 2 of FIGS. 23 and 24 with the broken lines showing the co-operating regions below the upper surface of the elements. It can be appreciated that movement of individual elements is restricted in a similar manner to those elements shown in FIG. 16.

We claim:

1. A roofing element comprising an upper surface and at least two pairs of oppositely facing side edges of which at least one pair of side edges is provided with co-operating members, each of which is adapted to cooperate with at least two further such roofing elements of which each is disposed adjacent one of said opposite side edges of said one pair, said co-operating members and each of said roofing elements being adapted to be so disposed in relation to one another that movement of one of said roofing elements would necessarily involve movement of at least two of said oppositely adjacent roofing elements, and at least one spacer member extending laterally from at least one of said side edges adapted for spacing said roofing element from an adjacent roofing element, said at least one spacer member being adapted to create an air-flow passage which is adapted to communicate between co-operating roofing elements and which is adapted to space edges of said upper surfaces from adjacent roofing elements along said at least one side edge from which said at least one spacer member extends.

2. A roofing element according to claim 1, wherein at least one spacer member is provided on at least one side edge of each pair of opposite side edges.

3. A roofing element according to claim 1, wherein said spacer member is located on said co-operating members.

4. A roofing element according to claim 1, wherein said co-operating members comprise at least one overlapping projection adapted to co-operate with at least one recess formed on said adjacent further roofing elements, and wherein said spacer member is provided on said at least one overlapping projection.

5. A roofing element as claimed in claim 1, comprising a generally rectangular body having top and bottom surfaces, first and second substantially parallel side edges and third and fourth side edges connecting said first and second side edges, said third and fourth side edges each having at least one projection and at least one recess, wherein said projection is in the form of an elongated wing member and said spacer member extends only partially along the length of said projection, thereby being adapted to create said air-flow passage in the form of a gap between co-operating roofing elements which would allow air to be drawn to an area of low pressure above said roofing elements.

6. A roofing element according to claim 5, wherein at least one of said first and second side edges is provided with at least one spacer member thereby which would allow a bidirectional flow of air through said roofing elements.

7. A roofing element according to claim 5, wherein said bottom surface is provided with at least one open-bottomed channel in communication with said air-flow passages adapted to be provided between co-operating roofing elements.

8. A roofing element according to claim 7, further comprising insulation material attached to said bottom surface, said insulation material being provided with at least one air-flow duct in communication with said open-bottomed channel.

9. A roofing element according to claim 1 wherein said upper surface of said roofing element is adapted to be substantially coplanar with the upper surface of all adjacent roofing elements.

* * * * *